United States Patent [19]

Fukuchi et al.

[11] Patent Number: 4,996,644

[45] Date of Patent: Feb. 26, 1991

[54] AIR-FUEL RATIO CONTROL SYSTEM FOR USE IN INTERNAL COMBUSTION ENGINE

[75] Inventors: Hiroshi Fukuchi, Kyoto; Mitsuaki Ishii; Masaaki Miyazaki, both of Hyogo, all of Japan

[73] Assignee: Mitsubishi Denki Kabushiki Kaisha, Tokyo, Japan

[21] Appl. No.: 393,869

[22] Filed: Aug. 14, 1989

Related U.S. Application Data

[63] Continuation of Ser. No. 146,943, Jan. 22, 1988, abandoned.

[30] Foreign Application Priority Data

Jan. 22, 1987 [JP] Japan ..... 62-12775
Jan. 22, 1987 [JP] Japan ..... 62-12776

[51] Int. Cl.[5] ..... F02M 7/00

[52] U.S. Cl. ..... 364/431.05; 364/431.07; 123/492; 123/442; 123/478

[58] Field of Search ..... 364/431.03, 431.04, 364/431.05, 431.07; 123/339, 478, 480, 492, 438, 442

[56] References Cited

U.S. PATENT DOCUMENTS

| | | | |
|---|---|---|---|
| 4,270,503 | 6/1981 | Pomerantz | 123/438 |
| 4,433,662 | 2/1984 | Muller et al. | 123/438 |
| 4,445,483 | 5/1984 | Hasegawa | 123/480 |
| 4,466,412 | 8/1984 | McChesney et al. | 123/492 |
| 4,542,726 | 9/1985 | Baltz et al. | 123/320 |
| 4,590,564 | 5/1986 | Ishikawa et al. | 364/431.07 |
| 4,597,370 | 7/1986 | Yasuoka et al. | 364/431.07 |
| 4,612,892 | 9/1986 | Iwanaga et al. | 123/438 |
| 4,635,200 | 1/1987 | Egani et al. | 364/431.07 |
| 4,682,577 | 7/1987 | Kato et al. | 123/492 |
| 4,706,632 | 11/1987 | Kasawami et al. | 123/480 |
| 4,729,356 | 3/1988 | Kaneko et al. | 123/399 |

*Primary Examiner*—Parshotam S. Lall
*Assistant Examiner*—V. N. Trans
*Attorney, Agent, or Firm*—Sughrue, Mion, Zinn, Macpeak & Seas

[57] ABSTRACT

An air-fuel ratio control system for use in an internal combustion engine is disclosed which comprises a supply unit equipped with a carburetor incorporating an acceleration pump for supplying fuel to the internal combustion engine and at least one duty-controlled solenoid valve adapted to controlling the air-fuel ratio; an operating condition detector for detecting the operating condition of the internal combustion engine; an acceleration controlled-variable decision unit for setting a predetermined acceleration controlled-variable being given to the solenoid valve during different acceleration control times corresponding to the operating condition or different acceleration; and a control variable decision unit for determining the controlled duty of the solenoid valve according to the data from the operating condition detecting unit and when the controlled variable is given by the acceleration controlled-variable decision unit at the time of acceleration, according to the acceleration control variable.

6 Claims, 8 Drawing Sheets

STARTING MODE
POWER MODE
DECELERATION MODE
IDLE SWITCH
OFF
ON
100%
θ
θ1
θ2
θ3
θ4
Z16
Z15
Z14
Z13
Z12
Z11
Z10
Z9
Z8
Z7
Z6
Z5
Z4
Z3
Z2
Z1
N1 (400)
N2 (1000)
N3 (2000)
N4 (4000)
N (RPM)

VTH
VO2
(RICH) 14.7 (LEAN)
A/F

START
END
200
θ > θ1 ?
201
θ > θ2 ?
202
θ > θ3 ?
203
θ > θ4 ?
208
2080
N < N2 ?
2081
N < N3 ?
2082
N < N4 ?
2086
SET ZONE CODE Z13
YES
NO
204
SET POWER ZONE CODES
205
SET Z4~Z16 IN RESPONSE TO N
206
SET Z3~Z15 IN RESPONSE TO N
207
SET Z2~Z14 IN RESPONSE TO N
2083
SET Z1
2084
SET Z5
2085
SET Z9

AIR-FUEL RATIO CONTROL SYSTEM FOR USE IN INTERNAL COMBUSTION ENGINE

This is a continuation of application Ser. No. 146,943, filed Jan. 22, 1988, now abandoned.

BACKGROUND OF THE INVENTION

The present invention relates to an air-fuel ratio control system for use in an internal combustion engine for an automobile or the like.

Heretofore, varieties of air-fuel ratio control systems for controlling the air-fuel ratio of the air-fuel mixture supplied to the combustion chamber of an automotive internal combustion engine are in use for fuel cost reduction or as an anti-exhaust measure. As disclosed by Japanese Patent Application (OPI) No. 59-196946, for instance, there is known a so-called feedback carburetor system equipped with a carburetor and a fuel control solenoid and used to converge the oxygen content of the exhaust gas up to the stoichiometric air-fuel ratio under feedback control by means of an oxygen sensor ($O_2$ sensor) during normal operation after the internal combustion engine is warmed up and to set the air-fuel ratio of an air-fuel mixture at a predetermined set value under open loop control at low temperatures, i.e., at the time of warming-up, starting, heavy-loading or slowing-down.

In such a feedback carburetor system, the air-fuel ratio at the time of acceleration is corrected by the quantity of fuel flow from the acceleration pump incorporated in the carburetor to improve operating performance.

However, since the acceleration pump is mechanically operated, the quantity of fuel flow is normally determined by the opening of the throttle and, when the system is operated under diversified operating conditions as in the case of an automobile, an optimum quantity of supply fuel can hardly be set in accordance with different accelerating conditions. Admittedly, rather excessive fuel will have to be normally supplied in view of operating performance and it is therefore difficult to meet highly developed demands of drivers in terms of operating performance and fuel cost.

SUMMARY OF THE INVENTION

The present invention is intended to solve the aforesaid problems and it is therefore an object of the invention to provide such an air-fuel ratio control system for use in an internal combustion engine as is capable of improving operating performance at the time of acceleration and deceleration without supplying excessive fuel.

An air-fuel ratio control system for use in an internal combustion engine according to the present invention is provided with acceleration controlled-variable decision means for detecting the accelerated operating condition of the internal combustion engine and controlling the solenoid valve of fuel supply means in conformity with a predetermined acceleration controlled-variable during acceleration control time corresponding to the acceleration and operating condition thereof.

When the accelerated operating condition is detected by the acceleration control variable decision means according to the present invention, the duty of the solenoid valve for supplying fuel is so controlled that the fuel quantity is increased in conformity with the predetermined acceleration controlled-variable during acceleration control time corresponding to the operating condition such as the acceleration, whereby a fuel quantity in addition to what is supplied by the acceleration pump is supplied in accordance with the accelerating condition.

An air-fuel ratio control system for use in an internal combustion engine according to the present invention is provided with acceleration controlled-variable decision means for detecting the accelerated operating condition of the internal combustion engine and controlling a fuel control solenoid to supply a fuel quantity corresponding to acceleration during a predetermined interval.

When the accelerated operating condition is detected by the acceleration controlled-variable decision means according to the present invention, the duty of the solenoid valve for supplying fuel is so controlled that the fuel quantity is increased during a predetermined interval by determining the fuel supply corresponding to the operating condition such as acceleration, whereby an optimum fuel quantity in addition to what is supplied by the acceleration pump is supplied in accordance with the accelerating condition.

DESCRIPTION OF THE PREFERRED EMBODIMENTS

Figure 1:
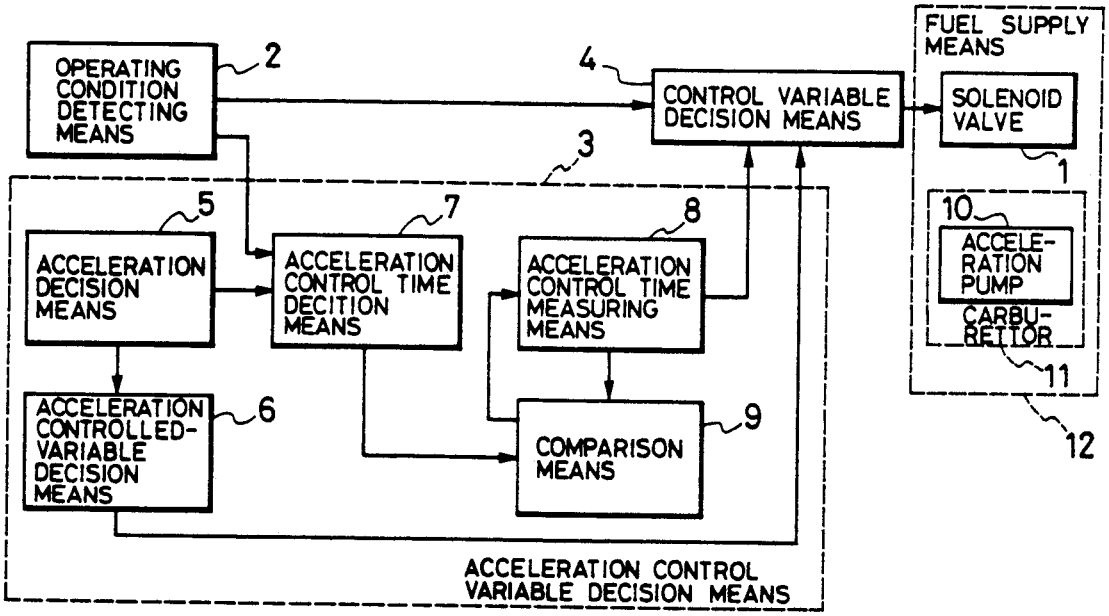
FIG. 1 is a functional block diagram of an embodiment of an air-fuel ratio control system for use in an internal combustion engine according to the present invention.

Referring now to the accompanying drawings, a description will be given of embodiments of the present invention in the form of an air-fuel ratio control system for use in an internal combustion engine. FIG. 1 is a functional block diagram representing an embodiment of the present invention. As shown in FIG. 1, fuel supply means 12 consists of a duty-controlled solenoid valve 1 for controlling a fuel supply and a carburetor 11 incorporating an acceleration pump 10.

The output of operating condition detecting means 2 for detecting the condition of each component part of the internal combustion engine is supplied to acceleration control time decision means 7 included in acceleration controlled-variable decision means 3 for determining the quantity of supply fuel at the time of acceleration and to controlled variable decision means 4.

The acceleration control-variable decision means 3 comprises acceleration decision means 5 for detecting the accelerated operating condition of an internal combustion engine; acceleration controlled-variable decision means 6 for supplying a predetermined controlled variable to the solenoid valve 1; acceleration control time decision means 7 for determining optimum acceleration control time corresponding to each operating condition according to the outputs of the operating condition detecting means 2 and the acceleration decision means 5; acceleration control time measuring means 8 for measuring the acceleration control time given by the acceleration control time decision means 7; and comparison means 9 for comparing the value given by the acceleration control time decision means 7 with the value of the residual time for acceleration control derived from the acceleration control time measuring means 8 when acceleration control time is newly set up and for selecting and setting longer time data to the acceleration control time measuring means 8.

The controlled variable decision means 4 determines the controlled variable of the solenoid valve 1 corresponding to each operating condition according to the signal from the operating condition detecting means 2 and simultaneously the controlled duty value of the solenoid valve 1 according to the acceleration controlled-variable of the acceleration controlled-variable decision means 6 while the acceleration control time measuring means 8 is measuring the acceleration control time.

The quantity of fuel fit for the operating condition, in addition to what is supplied by the acceleration pump 10 at the time of acceleration, is supplied by the solenoid valve 1 and the quantity of fuel required for accelerating operation is thus properly increased under control, so that operating performance is improved without the excessive supply of fuel.

Figure 2:
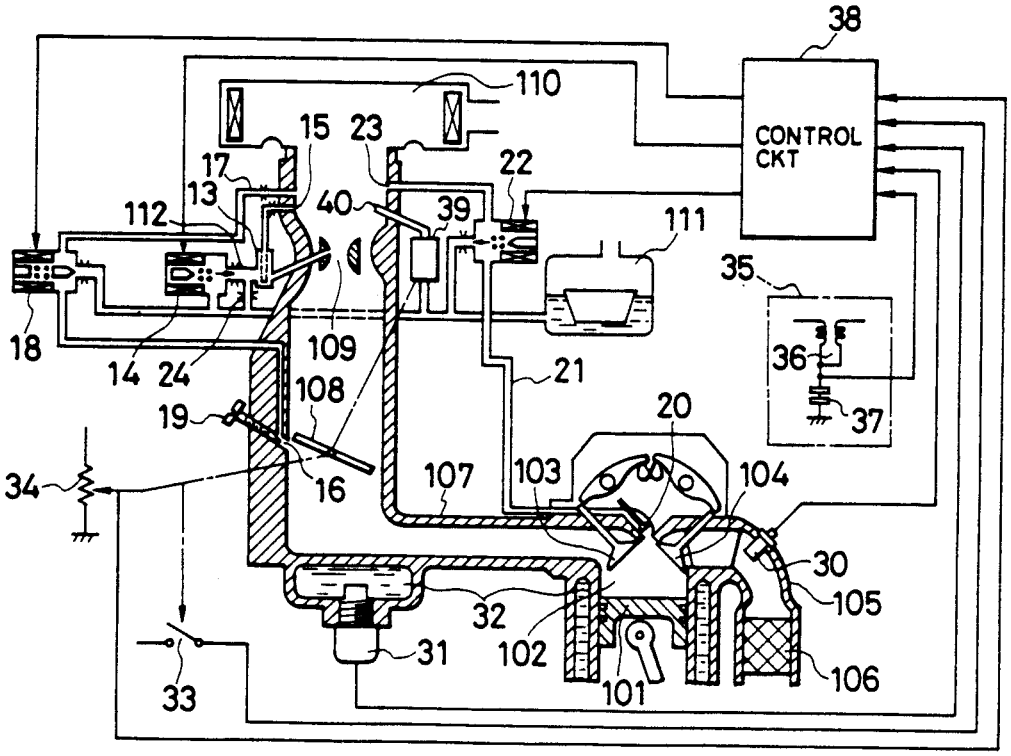
FIG. 2 is a diagram concretely showing the construction of the air-fuel ratio control system of FIG. 1 for use in an internal combustion engine.

FIG. 2 shows an embodiment of the functional block diagram of FIG. 1 in concrete terms. By reference to FIG. 2, a description will further be given of the construction of the engine including a piston 101, a cylinder 102, an intake valve 103 and an exhaust valve 104.

The exhaust gas discharged from the exhaust valve 104 is passed through a tercatalytic converter 106 via an exhaust pipe 105 before being discharged into the air.

Moreover, an intake passage 107 is provided with a throttle valve 108. A venturi 109 and an air cleaner 110 are installed in the upper stream of the throttle valve 108.

When the air taken via the air cleaner 110 passes the venturi 109, fuel in a float chamber 111 is sucked via main fuel passages 24, 112 and atomized to become an air-fuel mixture, which is supplied via the throttle valve 108 and the intake passage 107 to the cylinder 102.

In this case, a main air bleed 13 and a main fuel solenoid valve 14 are installed in the mid-main fuel passage 112 and the fuel led from the main fuel passage 112 up to the venturi 109 is made finer by the air taken in via a main air bleed passage 15 provided on the upperstream side of the venturi 109 before being introduced in the venturi 109.

Part of the fuel quantity led from the float chamber 11 to the main air bleed 13 is variable as the main fuel solenoid valve 14 switches The main fuel solenoid valve 14 is of a normal open type.

On the other hand, an idle port 16 is provided on the downstream side of the throttle valve 108 and a slow air bleed passage 17 on the upperstream side of the venturi 109 and further a slow fuel solenoid valve 18 in the slow fuel passage between the idle port 16 and the slow air bleed passage 17. The slow fuel solenoid valve 18 is held open in the idle state in which the throttle valve 108 is almost completely shut to have the fuel in the float chamber 111 sucked with the intake air from the slow air bleed passage 17, so that a jet of air-fuel mixture is sent out of the idle port 16.

The slow fuel solenoid valve 18 is of a normal closed type. The quantity of air-fuel mixture discharged from the idle port 16 is regulated by a slow adjust screw 19.

The throttle valve 108 is coupled to an accelerator pedal (not shown) and opened proportionately to the accelerator pedal operating quantity during traveling.

On the other hand, the cylinder 102 is provided with a small diameter jet valve 20 in addition to the intake valve 103 and a jet fuel passage 21 is provided in parallel with a passage of the air-fuel mixture led from the venturi 109 up to the intake valve 103 between the jet valve 20 and the upperstream side of the venturi 109. When a jet fuel solenoid valve 22 adapted to switching the fuel passage led from the float chamber 111 opened in the middle of jet fuel passage 21 is opened, the fuel in the float chamber 111 is sucked with the intake air from a jet air inlet 23 to form a high-speed air-fuel mixture, which is sent out by the jet valve 20 and jetted into the cylinder 102. The high-speed air-fuel mixture independent of what is led from the intake pipe 107 is thus forced in the cylinder 102, so that a swirl of air-fuel mixture is produced in the cylinder 102.

In this case, the jet fuel solenoid valve 22 is of a normal open type.

An acceleration pump 39 cooperates with the throttle valve 108 and adapted to directly jetting the fuel via a nozzle 40 to the upper part of the venturi 109 in proportion to a change of flow rate in the throttle valve 108.

An air-fuel control system configuration will subsequently be described. As shown in FIG. 2, the control system includes an oxygen sensor 30 for detecting the oxygen content of the exhaust gas and a temperature sensor 31 for detecting the temperature of engine cooling water. The outputs of the oxygen and temperature sensors 30, 31 are applied to a control circuit 38.

An idle switch 33 is turned on (closed) while the throttle valve 108 is almost completely shut, i.e., during idling and it is connected to the control circuit 38.

A valve opening detector 34 is coupled to the rotary shaft of the throttle valve 108 and caused to output a voltage signal corresponding to the opening of the throttle valve 108, its moving terminal being also connected to the control circuit 38.

An engine speed detector 35 for detecting engine speed N obtains an angular pulse signal with a period corresponding to the engine speed N from the connecting point of an ignition coil 36 and an interrupter 37.

The angular pulse signal is also applied to the control circuit 38.

Based on the output signals thus detected by the aforesaid oxygen sensor 30-engine speed detector 35, the control circuit 38 operates to control the air-fuel ratio in every operating condition after the engine is started in such a manner as to conform the air-fuel ratio to the theoretic one or set it at a set value by switching the openings of the main fuel solenoid valve 14, the slow fuel solenoid valve 18 and the jet fuel solenoid valve 22.

In this case, though the slow fuel solenoid valve 18 is held either on or off, the main fuel and jet fuel solenoid valves 14, 22 are operated so that the on-to-off duty ratio of each is controlled.

Figure 3:
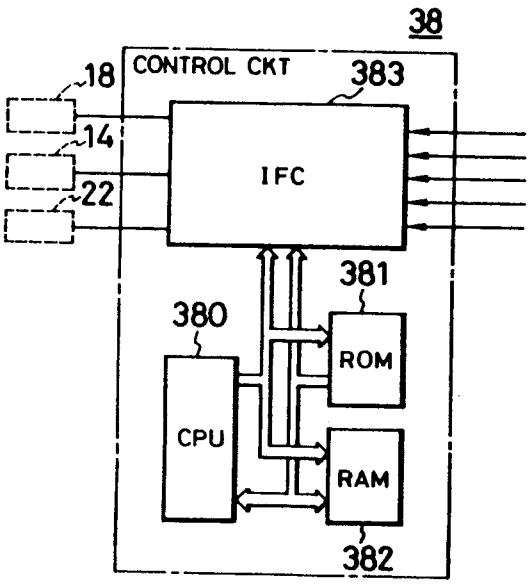
FIG. 3 is a block diagram showing the construction of a control circuit in the air-fuel ratio control system for the internal combustion engine of FIG. 2.

As shown in FIG. 3, the control circuit 38 consists of a Central Processing Unit (CPU) 380, a Read Only Memory (ROM) 381 for storing programs and constants for use in controlling air-fuel ratios, a Random Access Memory (RAM) 382 for storing the results obtained in course of processing, and an Interface Circuit (IFC) 383 for sending and receiving signals to and from the oxygen sensor 30, the main fuel solenoid valve 14 and so forth.

With respect to the operation of the system thus configured, a further description will be given by reference to flowcharts of FIGS. 4, 5, 10–12.

Figure 4:
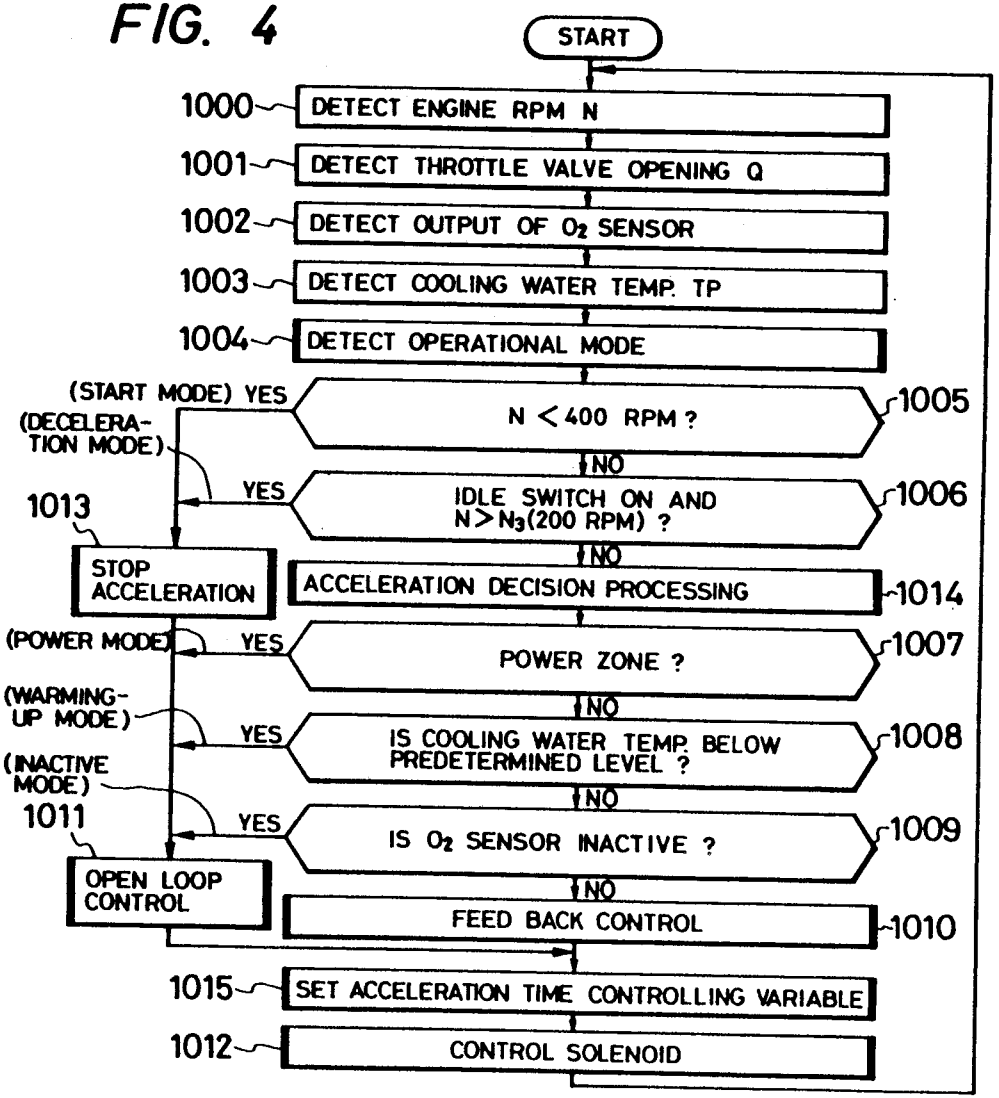
FIGS. 4 and 5 are flowcharts illustrating the operation of the control circuit thereof.

When the engine is started, the CPU 380 follows the main routine shown in FIG. 4 according to the program stored in the ROM 381; i.e., the CPU 380 reads the output signal of the engine speed detector 35 in STEP 1000 and detects the present engine speed N by measuring the period of the output signal.

In STEP 1001, the CPU 380 reads the output signal of the valve opening detector 34 and detects the opening $\theta$ of the throttle valve 108.

In this case, since the output signal of the valve opening detector 34 is an analog voltage signal corresponding to the valve opening, it is converted into a digital signal in the IFC before being read to the CPU 380.

Subsequently in STEP 1002, the CPU 380 reads the output signal of the oxygen sensor 30 and detects the oxygen content of the exhaust gas in the present operating condition.

In this case, the output signal of the oxygen sensor 30 is compared with a reference voltage in the IFC and converted into a high or low level signal before being read to the CPU 380.

The CPU 380 then reads the output signal of the temperature sensor 31 in STEP 1003 and detects the present cooling water temperature TP.

In this case, the output signal of the temperature sensor 31 is converted into a digital signal in the IFC and read to the CPU 380.

The CPU 380 reads the output signals of those sensors and thus detects the engine speed N, the throttle valve opening $\theta$, the oxygen content PPM and the cooling water temperature TP and subsequently detects the present operating condition in STEPs 1004–1009; i.e., based on the engine speed N and the throttle valve opening $\theta$, it detects that the operating mode of the engine is in either starting mode or power mode at the time of heavy-load traveling, or otherwise the engine is in accelerated operating condition.

The operating modes in this embodiment are classified into an inactive mode prior to warming-up in which the function of the oxygen sensor 30 is not properly demonstrated; a warming-up mode in which the cooling water temperature has not yet sufficiently been raised; a steady-state mode at the time of light loading or constant-speed operation after the completion of warming-up; a starting mode in which the engine speed N is at less than 400 RPM; a power mode at the time of heavy-load traveling; and a deceleration mode in which the engine speed N is at more than 2,000 RPM while the acceleration pedal is left untouched (i.e., the idle switch 33 is held on). In the cases of the power, warming-up and inactive modes at the time of accelerated operating condition, an increase of fuel quantity for acceleration is made by subtracting the controlled duty of the main fuel solenoid valve 14 set in each mode from the acceleration increasing duty corresponding to the acceleration.

Figure 6:
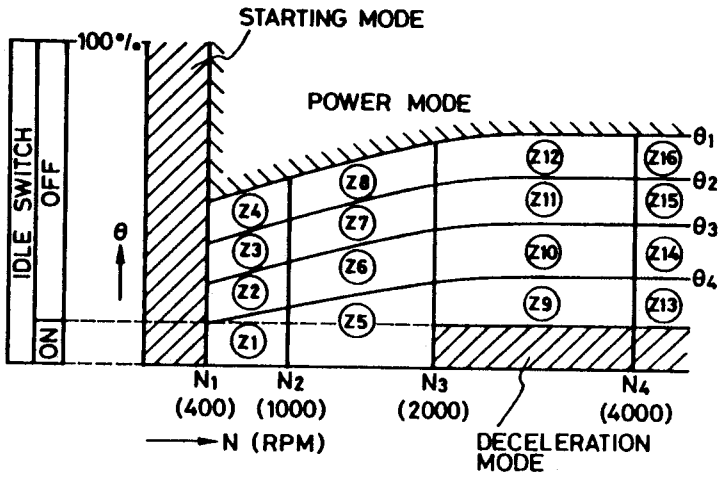
FIG. 6 is a graph showing the relation of a deceleration mode to corresponding engine speed vis throttle valve opening in the aforesaid embodiment above.

As shown in FIG. 6, the inactive, warming-up and steady-state modes are divided into 16 kinds of zones Z1–Z16 according to the engine speed N and the throttle valve opening $\theta$.

Consequently, the CPU 380 first detects, in STEP 1004, under which one of the zones the present operating condition falls in STEP 1004.

Figure 5:
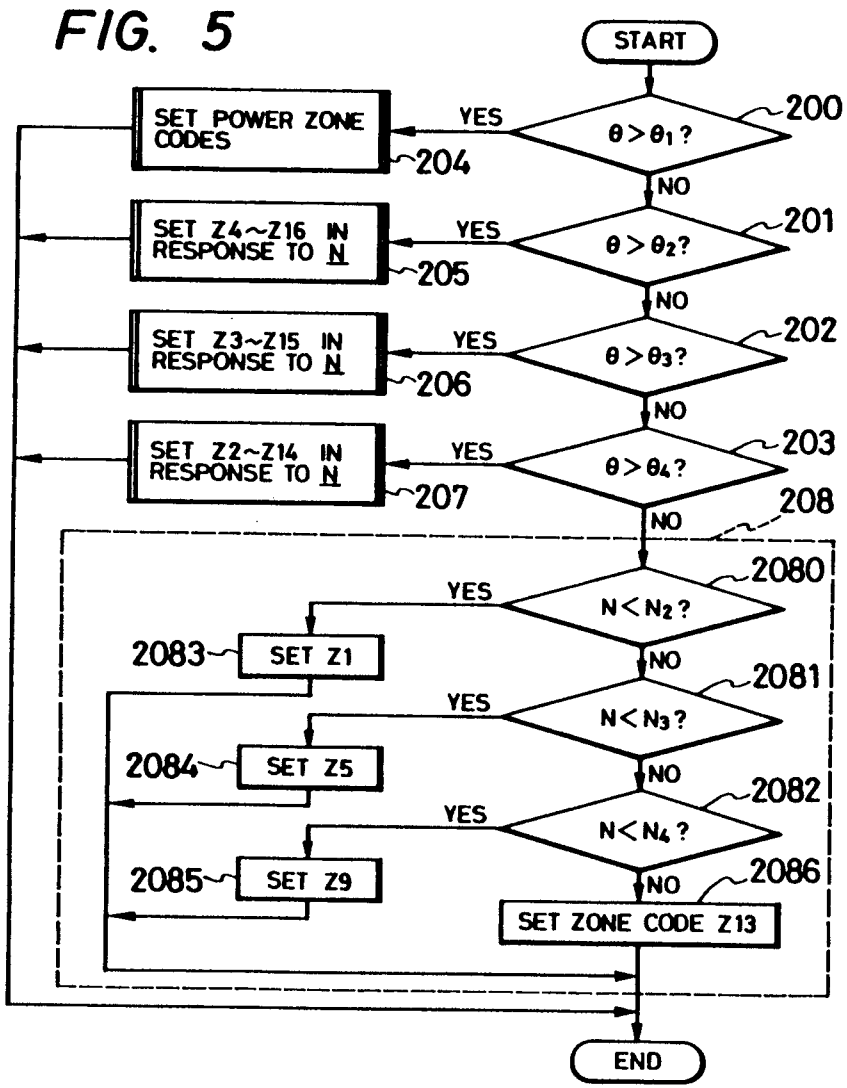

More specifically, as shown in a detailed flowchart of FIG. 5, the present throttle valve opening $\theta$ is compared, in STEPs 200–203 first, with four reference values $\theta_1$–$\theta_4$ (however, $\theta_1>\theta_2>\theta_3>\theta_4$) of the throttle valve opening determined correspondingly to the engine speed to divide the zone and, if $\theta>\theta_1$, a power zone code indicating a power zone is set to a register provided in the RAM 382 for identifying the operating condition in STEP 204.

If $\theta_2<\theta<\theta_1$, one of the zone codes showing the zones Z4–Z16 is further selected according to the engine speed N and set in STEP 205 and subsequently, if $\theta_3<\theta<\theta_2$, one of the zone codes showing the zones Z3–Z15 is still further selected according to the engine speed N and set in STEP 206.

If $\theta_4<\theta<\theta_3$ moreover, one of the zone codes showing the zones Z1–Z14 is further selected according to the engine speed N and set in STEP 207 and subsequently, if $\theta<\theta_4$, one of the zone codes showing the zones Z1–Z13 is still further selected according to the engine speed N an set in STEP 208.

In the processes shown in STEPs 205–208, which are representatively illustrated in STEP 208, four reference values $N_1$ (=400 RPM), $N_2$ (=1,000 RPM), $N_3$ (=2,000 RPM), $N_4$ (=4,000 RPM) of the engine speed employed to determined the division of the zone are compared with the present engine speed N in STEPs 2080–2082 and, depending on the results of comparison, one of the zone codes Z1, Z5, Z9 is selected in STEP 2083–2086 and set to the register for identifying the operation condition, respectively.

After detecting the operating zone in that manner, the CPU 380 detects that the operating condition falls under one of the starting mode-steady-state mode and, according to the result thus detected, selects to control the air-fuel ratio by means of an open or feedback loop in STEPs 1005–1009.

After comparing the engine speed N with the reference value $N_1$ (=400 RPM), the CPU 380 detects the starting mode in STEP 1005 if $N<N_1$.

In STEP 1006, the CPU 380 compares the engine speed N with the reference value $N_3$ (=2,000 RPM) and detects the deceleration mode, provided $N_3>N$ and the idle switch is held on. In STEP 1007, the CPU 380 checks whether the power zone code is set to the register for identifying the operating condition and, if it is set, detects the power mode.

The CPU 380 compares the present cooling water temperature TP with a reference value $TP_0$ and detects the warming-up mode in STEP 1008 if $TP<TP_0$.

In STEP 1009 further, the CPU 380 compares the output voltage signal $V_{02}$ of the oxygen sensor 30 with a reference value V and detects the inactive mode of the oxygen sensor, provided the state of $V_{02}<V$ continues for the predetermined length of time (e.g., 10 seconds). The CPU 380 selects processing under open loop control in STEP 1011 in the starting, power, deceleration, warming-up and inactive modes while selecting processing under feedback control in STEP 1010 in any other mode, i.e., the steady-state mode.

In other words, the CPU 380 always selects the processing under the open loop control in STEP 1011 in such an operating mode that the feedback control based on the output of the oxygen sensor 30 is impossible (starting, warming-up, inactive modes), that the feedback control is unnecessary because priority is given to horsepower instead of the stoichiometric air-fuel ratio (power mode) and in a special mode in which the implementation of the feedback control is meaningless (deceleration mode).

In STEP 1014, on the other hand, the CPU 380 detects the rate of change of the throttle valve 108 from the rate of change of a throttle sensor 34 at predetermined time intervals and sets the controlled duty corresponding to a fuel increase in the main fuel solenoid valve 14 at the time of acceleration and an acceleration increasing timer (TMACC).

In STEP 1013, the process of suspending the fuel increase control at the time of acceleration in the starting and the deceleration modes.

In STEP 1015, the CPU 380 subtracts the acceleration increasing duty value Da% set in STEP 1014 from the controlled duty determined prior to this step and gives the main fuel solenoid valve 14 the controlled duty increased by a supply fuel quantity at the time of acceleration.

In STEP 1012, subsequently, the CPU 380 controls the operation of the main fuel solenoid valve 14, the slow fuel solenoid valve 18 and the jet fuel solenoid valve 22.

In the operating mode not in conformity with the aforesaid operating condition, i.e., the steady-state mode at the time of light loading or constant-speed revolution after the completion of warming-up, the CPU 380 selects the processing under the feedback control in STEP 1010, performs the process of proportionally integrating the output signal of the oxygen sensor 30, and determines the on(closed)-to-off time ratio (pulse duty) of the jet fuel solenoid valve 22. In STEP 1012 further, the CPU 380 drives the jet fuel solenoid valve 22 according to the result processed in STEP 1010 and, by performing proportional integration control (PI control), converges the air-fuel ratio of the air-fuel mixture supplied to the cylinder 102 at up to the stoichiometric air-fuel ratio.

Figure 7:
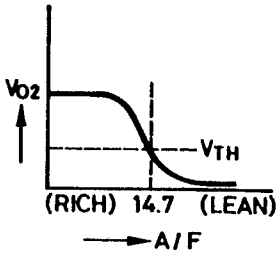
FIG. 7 is a graph showing the relation between the air-fuel ratio of an oxygen sensor to the output voltage thereof in the aforesaid embodiment.
Figure 8A:
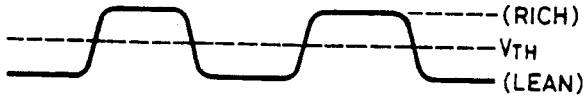
FIGS. 8(*a*) and 8(*b*) are time charts for distinguishing the relation between the rich and lean to voltage corresponding to the output voltage of the oxygen sensor and the theoretic air-fuel ratio.
Figure 8B:
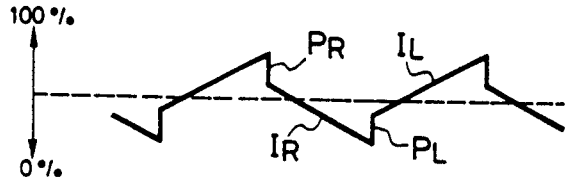

More specifically, because the output voltage signal $V_{02}$ of the oxygen sensor 30 is held at a high voltage level when the air-fuel ratio remains on the rich side and at a low level when it remains on the lean side as shown in FIG. 7, the CPU 380 sets a voltage corresponding to the stoichiometric air-fuel ratio (=14.7) to a reference voltage $V_{TH}$ and distinguishes between the rich and lean whenever the output voltage signal $V_{02}$ of the Oxygen sensor 30 crosses the reference voltage $V_{TH}$. The CPU 380 then determines a controlled quantity by processing the signal thus distinguished with the proportional integration as shown by a time chart of FIG. 8 and correspondingly controls the duty ratio $D_J$ of a fixed periodic driving pulse signal for the jet fuel solenoid valve 22. The description of STEPs 1015, 1012 will be omitted as it has already been given.

Figure 9:
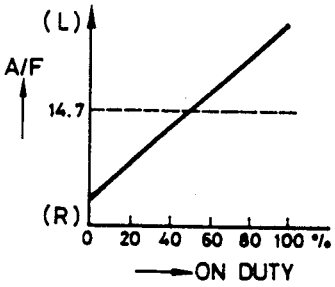
FIG. 9 is a graph showing the relation between the on-time duty of a jet fuel solenoid valve and the air-fuel ratio in the aforesaid embodiment.

As is obvious from the description above, the air-fuel ratio of the air-fuel mixture supplied to the cylinder 102 is controlled as shown in FIG. 9 so that it is set on the lean side in proportion as the on-time duty of the jet fuel solenoid valve 22 is prolonged and inversely on the rich side as the on-time duty is shortened.

Since the feedback control is continuously implemented like that, the air-fuel ratio of the air-fuel mixture supplied to the cylinder 102 is converged at the stoichiometric air-fuel ratio.

In this case, the main fuel solenoid valve 14 is operated in a completely closed state under the feedback control as the duty ratio of the driving pulse therefor is set at 100% as shown in Table 1, whereas the slow fuel solenoid valve 18 is operated in a completely open state as the driving pulse is set on the on-side.

Accordingly, one air-fuel mixture passed through the jet valve 20, another passed through the bypass passage 24 of the main fuel solenoid valve 14, atomized in the venturi 109 and then passed through the intake valve 103, and still another from the idle port 16 are supplied to the cylinder 102.

In the steady-traveling state under the feedback control, the air-fuel ratios of the air-fuel mixtures via those three passages are so controlled as to conform to the stoichiometric air-fuel ratio by changing the air-fuel ratio of the air-fuel mixture only from the jet valve 20.

TABLE 1

| | Jet fuel solenoid valve | Main fuel solenoid valve | Slow fuel solenoid valve |
|---|---|---|---|
| Feedback control | Duty ratio | Duty ratio | Duty ratio |
| | PI control | 100% (fully closed) | ON (fully opened) |

In this case, proportionality factors $P_R$, $P_L$ on the rich and lean sides respectively and integration factors on the rich and lean sides respectively under the P1 control are defined as shown in Table 2 on an operating zone basis and controlled in a fine manner.

However, fuel equivalent to the acceleration increasing duty (Da%) is temporarily supplied from the main fuel solenoid valve 14 in STEP 1015 of the flowchart of FIG. 4 at the time of acceleration. When the acceleration pump 39 is corrected to thereby improve operation performance, the air-fuel ratio becomes temporarily richer than the stoichiometric air-fuel ratio but it is fed back to the stoichiometric air-fuel ratio again under the PI control after acceleration increasing time is terminated.

TABLE 2

| | PI gain | | | |
|---|---|---|---|---|
| Zone | PR (%) | IR (%/sec) | PL (%) | IL (%/sec) |
| Z1 | 10 | 5 | 10 | 5 |
| Z2 | 12 | 5 | 12 | 5 |

TABLE 2-continued

| Zone | PI gain PR (%) | IR (%/sec) | PL (%) | IL (%/sec) |
|---|---|---|---|---|
| Z3 | 12 | 6 | 12 | 6 |
| ... | ... | ... | ... | ... |
| ... | ... | ... | ... | ... |
| ... | ... | ... | ... | ... |
| ... | ... | ... | ... | ... |
| Z16 | 5 | 10 | 5 | 10 |

In the processing under the open loop control in STEP 1011 of FIG. 4, the CPU 380 controls the solenoid valves 14, 18, 22 with the duty ratio shown in the following tables 3–6 on an operating mode basis.

TABLE 3

| | | Jet fuel solenoid Valve Duty ratio | Main fuel solenoid Valve Duty ratio | Slow fuel solenoid Valve On-off |
|---|---|---|---|---|
| Open loop control | Starting mode | 0% Fully open | 0% Fully open | ON Fully open |
| | Power mode | Table 4 | Table 4 | ON |
| | Deceleration mode | 100% (fully closed) | 100% (fully closed) | OFF (fully closed) |
| | Warming-up mode | Table 5 | Table 5 | ON |
| | Inactive mode | Table 6 | 100% (fully closed) | ON |

TABLE 4

| | ~1,000 RPM | 1,000~ 2,000 RPM | 2,000~ 4,000 RPM | 4,000 RPM |
|---|---|---|---|---|
| Main fuel solenoid valve | 0% | 25% | 15% | 0% |
| Jet fuel solenoid valve | 40% | 40% | 40% | 40% |

In other words, the CPU 380 rotates the engine using the air-fuel mixture only from the idle port 16 while keeping only the slow fuel solenoid valve 18 fully opened in the starting mode. In the power mode, however, the CPU 380 controls the air-fuel ratio of the air-fuel mixture supplied into the cylinder 102 by setting the duty ratios of the main fuel solenoid valve 14 and the jet fuel solenoid valve 22 in proportion to the engine speed N as shown in Table 4.

In the deceleration mode, moreover, the CPU 380 holds all the three solenoid valves 14, 18, 22 in a closed state to cut off the fuel.

In the warming-up mode, further, the CPU 380 sets the duty ratios of the main fuel solenoid valve 14 and the jet fuel solenoid valve 22 on an operating zone basis as shown in Table 5 and controls the air-fuel ratio of the air-fuel mixture supplied into the cylinder 102.

In the inactive mode, however, the CPU 380 sets the duty ratio of the main fuel solenoid valve 14 at 100% to keep it in a fully closed state and control the air-fuel ratio of the air-fuel mixture by setting the duty ratio of the jet fuel solenoid valve 22 on an operating zone basis as shown in Table 6.

TABLE 5

| Zone | Warming-up mode Jet fuel solenoid valve | Main fuel solenoid valve |
|---|---|---|
| Z1 | 40 (%) | 100 (%) |
| Z2 | 34 | 56 |
| Z3 | 18 | 22 |
| ... | ... | ... |
| ... | ... | ... |
| ... | ... | ... |
| Z16 | 0 | 0 |

TABLE 6

| Zone | Warming-up mode Jet fuel solenoid valve |
|---|---|
| Z1 | 40 (%) |
| Z2 | 41 |
| Z3 | 35 |
| ... | ... |
| ... | ... |
| ... | ... |
| Z16 | 22 |

In the steady-state, warming-up and inactive modes, the duty ratios of the main fuel solenoid valve 14 and the jet fuel solenoid valve 22 are set on an operating basis as determined according to the engine speed N and the throttle valve opening $\theta$, so that the air-fuel ratio is controllable in a fine way depending on the steady traveling state.

Figure 10:
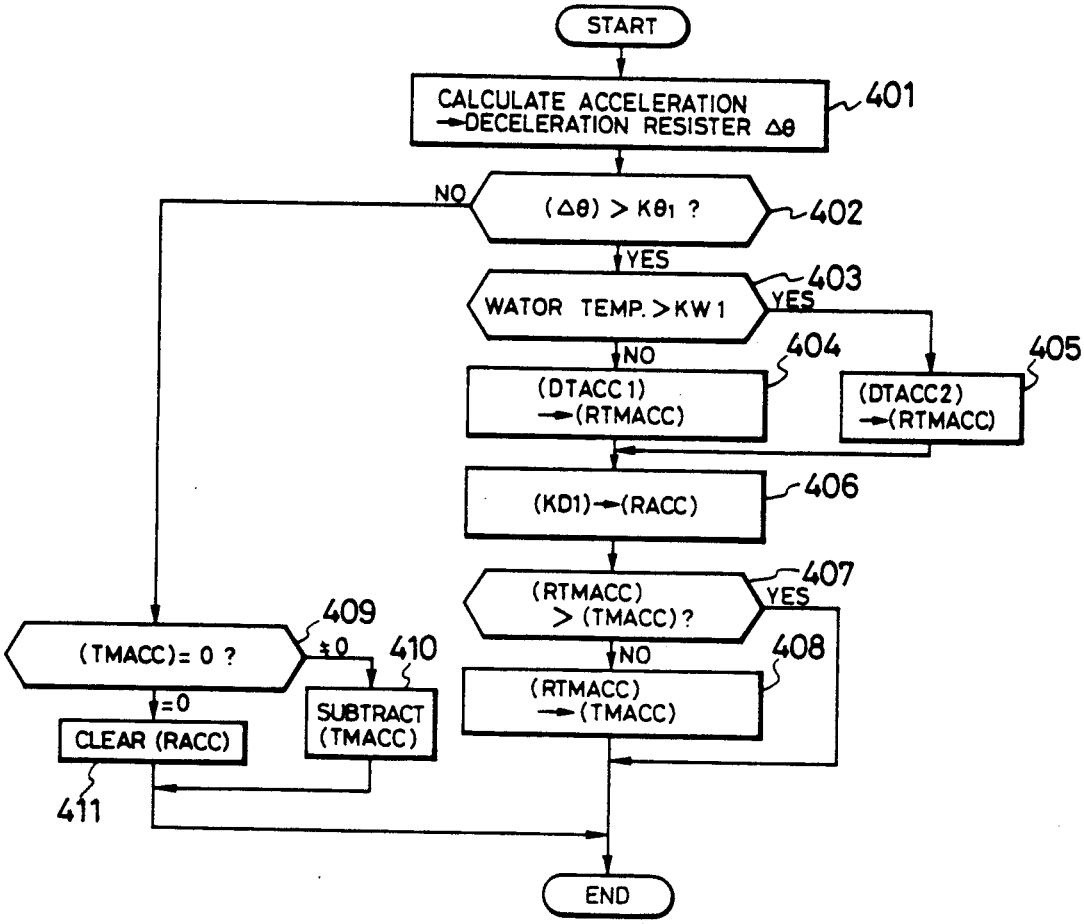
FIGS. 10 to 12 are flowcharts illustrating the details of part of the flowchart of FIG. 4.

Referring to FIGS. 10–14, the relevant details of STEPs 1013, 1014, 1015 at the time of accelerating operation in the flowchart of FIG. 4 will be described. FIG. 10 shows the illustration details of STEP 1014 of FIG. 4.

In STEP 401 of FIG. 10, the rate of change of the valve opening is detected from the difference of the output signal of the valve opening detector 34 at fixed time intervals of, e.g., 80 msec and stored in an acceleration register $\Delta\theta$.

In STEP 402, the CPU 380 proceeds to STEP 403 when the rate of change of the valve opening exceeds a predetermined range of change $K\theta_1$. In STEP 403, the CPU 380 sets acceleration increasing time DTACC1 to an acceleration increasing time register RTMACC when the cooling water temperature is lower than a predetermined value $K\theta_1$ judging from the output signal of the temperature sensor 31.

In STEP 403, on the other hand, the CPU 380 sets acceleration increasing time for high temperature use DTACC2 which is shorter than the acceleration increasing time for low temperature use DTACC1 to the acceleration increasing time register RTMACC when the cooling water temperature is higher than the predetermined value $K\theta_1$ and proceeds to STEP 406.

In STEP 406, the CPU 380 stores a predetermined acceleration increasing duty KD1 in an acceleration increasing duty storage register RACC.

In STEPs 407, 408 after the accelerated operating condition is detected in STEP 402, the CPU 380 compares acceleration increasing time data newly set up in STEP 404 or 405 with an acceleration increasing time measuring timer TMACC for measuring residual accelerating increasing time and operates in such a manner that the contents of any timer or register storing a greater value are left in the acceleration increasing time measuring timer TMACC.

On detecting what is lower than the rate of change of the valve opening $K\theta_1$ predetermined in STEP 402, the CPU 380 assumes that the steady-state operating condition has been restored and proceeds to STEP 409 and then STEP 410 when the residual time of the acceleration increasing time measuring timer TMACC is not "0". The CPU 380 subtracts the contents of the acceleration increasing time measuring timer TMACC each time the predetermined time elapses and, when the residual time of the acceleration increasing time measuring timer TMACC is still not "0" after the termination of the subtraction, operates so that the subtraction is made if the predetermined time has elapsed in STEP 410. Then the CPU 380 proceeds to STEP 411 provided the acceleration increasing time measuring timer TMACC is "0" in STEP 409, and clears an acceleration increasing duty storage register RACC.

Figure 11:
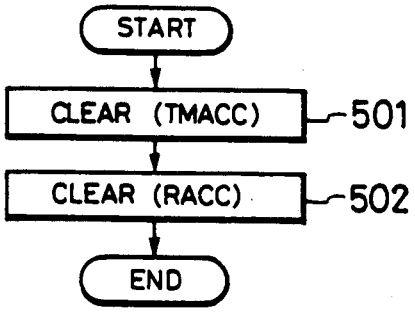

FIG. 11 shows the details of STEP 1013 of FIG. 4. Since no acceleration increase is needed during the starting and deceleration modes, the CPU 380 clears the contents of the acceleration increasing duty storage register RACC and the acceleration increasing time measuring timer TMACC in STEPs 501, 502.

Figure 12:
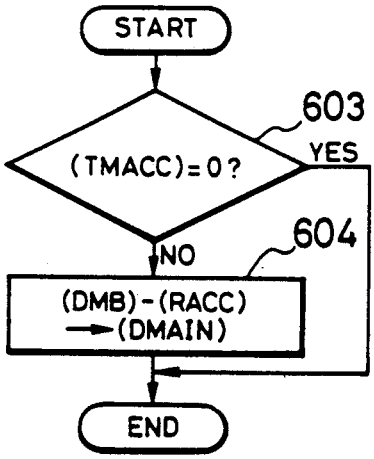

In STEP 1015 of FIG. 4, the CPU 380 proceeds from STEP 603 to STEP 604 only when the acceleration increasing time measuring timer TMACC is not "0" as shown in FIG. 12 and subtracts the contents of the acceleration increasing duty storage register RACC determined in STEP 1014 of FIG. 4 from the basic controlled duty of the main fuel solenoid valve 14 set in STEPs 1010, 1011 of FIG. 4 and increases fuel equivalent in quantity to the acceleration increasing duty Da% for a time corresponding to the operating condition.

The reason for the necessity of the processing in STEPs 407, 408 of FIG. 10 will be described. If the acceleration increasing time in each STEP 404, 405 is determined without the processing in STEPs 407, 498, irregularities shown in FIG. 13 will occur when the acceleration increasing time DTACC1 or DTACC2 is directly written.

Figure 13:
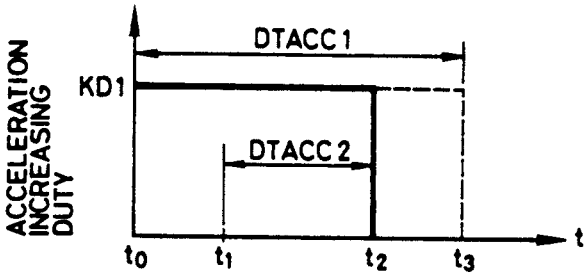
FIGS. 13 and 14 are graphs illustrating the details of the flowchart of FIG. 10.

More specifically, the acceleration control condition is established at $t_0$ in FIG. 13 and the acceleration increase time measuring time TMACC starts measuring the time DTACC1 after the acceleration increasing time DTACC1 set in STEP 404 of FIG. 10 is set. Then accelerating condition is newly established at $t_1$ and, after the acceleration increasing time DTACC2 is set to the acceleration increasing time measuring timer TMACC in STEP 405 and after acceleration increasing time is measured in STEPs 409, 410, 411, the acceleration increasing time DTACC2 elapses at $t_2$ and the contents of the acceleration increasing duty storage register RACC are cleared. This means the acceleration that should have been increased up to $t_3$ is interrupted in a short period of time and therefore operating performance is inconveniently deteriorated.

Figure 14:
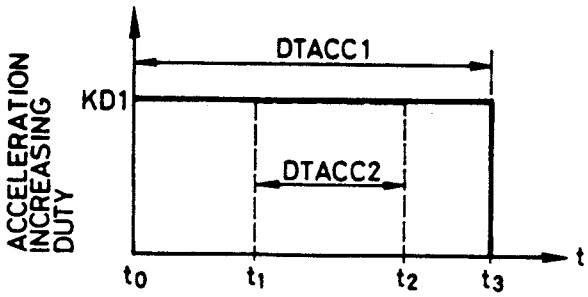

When the accelerating condition is caused by the addition of the countermeasures shown in STEPs 407, 408 and the timing referred to in FIG. 13, the acceleration increasing duty shown in FIG. 14 will be given and consequently any reduction in operating performance can be prevented.

As set forth above, since the acceleration increasing duty is given to the main fuel solenoid valve during the acceleration increasing time corresponding to the accelerating operation, it becomes possible to control fuel injection time that cannot be implemented by the acceleration pump by setting the basic fuel injection of the acceleration pump 39 at a rather small value and supplying the required fuel quantity in conformity with the accelerated operating condition from the main fuel solenoid valve 14, so that operating performance at the time of acceleration can be improved.

Although the description above refers to an example wherein the main fuel solenoid valve 14 is not used in the steady-state mode under the feedback control, the present invention is needless to say applicable to the solenoid valve even when only one solenoid valve is used under the feedback control for air-fuel ratio control.

Although the description above refers to an example where the increasing duty is separately computed at the time of acceleration to correct the basic controlled reference, the accelerating operation may be set as one of the open loop conditions.

As set forth above, the predetermined acceleration controlled-variable is given to the fuel control solenoid valve during the acceleration increasing time corresponding to acceleration at the time o accelerating operation and the fuel injection quantity supplied by the acceleration pump incorporated in the carburetor at the time of acceleration can be set at a rather small value according to the present invention. Consequently, the present invention has the effect of obtaining an inexpensive system capable of satisfying the operating performance requirements while minimizing supply fuel.

Another embodiment will be described with reference to FIGS. 15 to 18 in which an air-fuel ratio control system for use in an internal combustion engine is provided with acceleration control variable decision means for detecting the accelerated operating condition of the internal combustion engine and controlling a fuel control solenoid to supply a fuel quantity corresponding to acceleration during a predetermined interval. Description will be made only as to the difference over the first embodiment.

Figure 15:
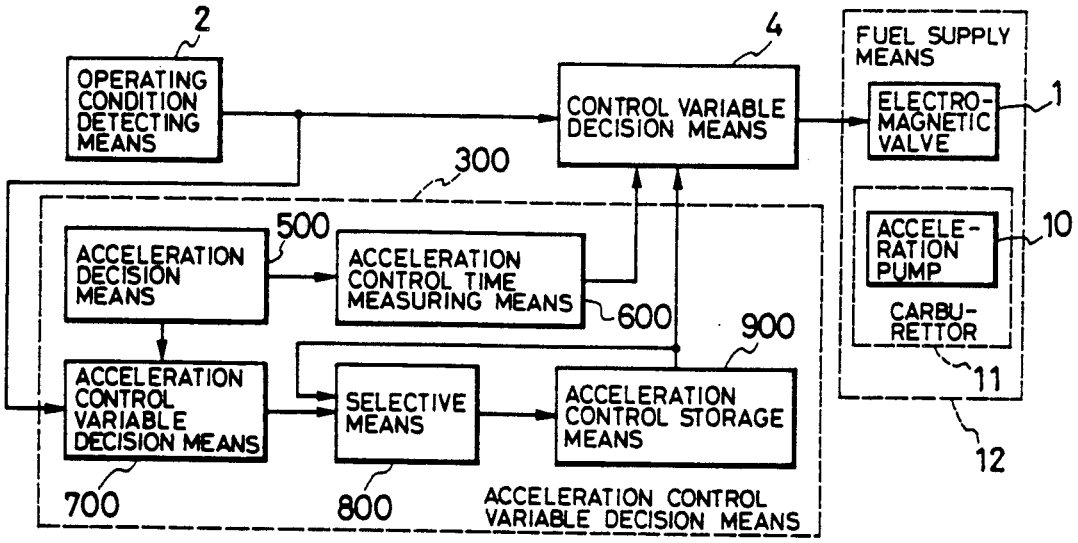
FIG. 15 is a functional block diagram of another embodiment of an air-fuel ratio control system for use in an internal combustion engine according to the present invention.

Referring now to FIGS. 15 to 18 description will be given of the embodiment of the present invention in the form of an air-fuel ratio control system for use in an internal combustion engine. As shown in FIG. 15, fuel supply means 12 consists of a duty-controlled solenoid valve 1 for controlling a fuel supply and a carburetor 11 incorporating an acceleration pump 10.

The output of operating condition detecting means 2 for detecting the condition of each component part of the internal combustion engine is supplied to acceleration controlled-variable decision means 700 included in acceleration controlled-variable decision means 300 for determining the fuel supply at the time of acceleration and to controlled-variable decision means 4.

The acceleration control variable decision means 300 comprises acceleration decision means 500 for detecting the accelerated operating condition of an internal combustion engine (shown in FIG. 2); acceleration control time measuring means 600 for measuring time during which a fuel quantity is supplied by the solenoid valve 1 for a predetermined interval at the time of acceleration after the accelerated operating condition is detected by the acceleration decision means 500; acceleration control variable decision means 700 for computing a different acceleration controlled-variable corresponding to the acceleration detected by the acceleration decision means 500; acceleration controlled-variable storage means 900 for storing the acceleration controlled-variable while acceleration is being controlled, the contents thus stored being cleared after the termination of acceleration control time; selective means 800 for comparing the outputs of the acceleration controlled-variable decision means 700 and the acceleration control variable storage means 900 to let the acceleration controlled-variable storage means 900 store an output signal designating a fuel supply which is greater in quantity.

The controlled variable decision means 4 determines the controlled variable of the solenoid valve 1 corresponding to each operating condition according to the signal from the operating condition detecting means 2 and simultaneously the controlled variable, i.e., the controlled duty of the solenoid valve 1 according to the acceleration controlled-variable while the acceleration controlled variable is being outputted by the acceleration controlled-variable decision means 300.

Figure 17:
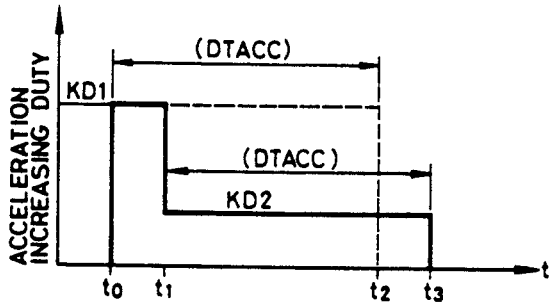
FIGS. 17 and 18 are graphs illustrating the details of the flowchart of FIG. 4.
Figure 18:
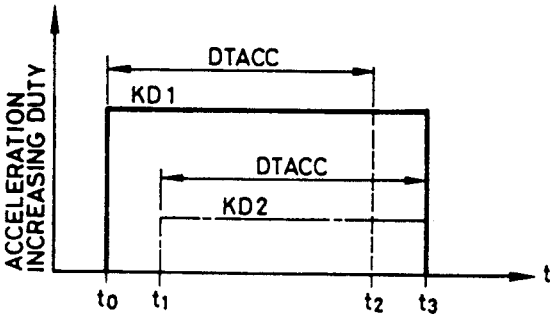
Figure 16:
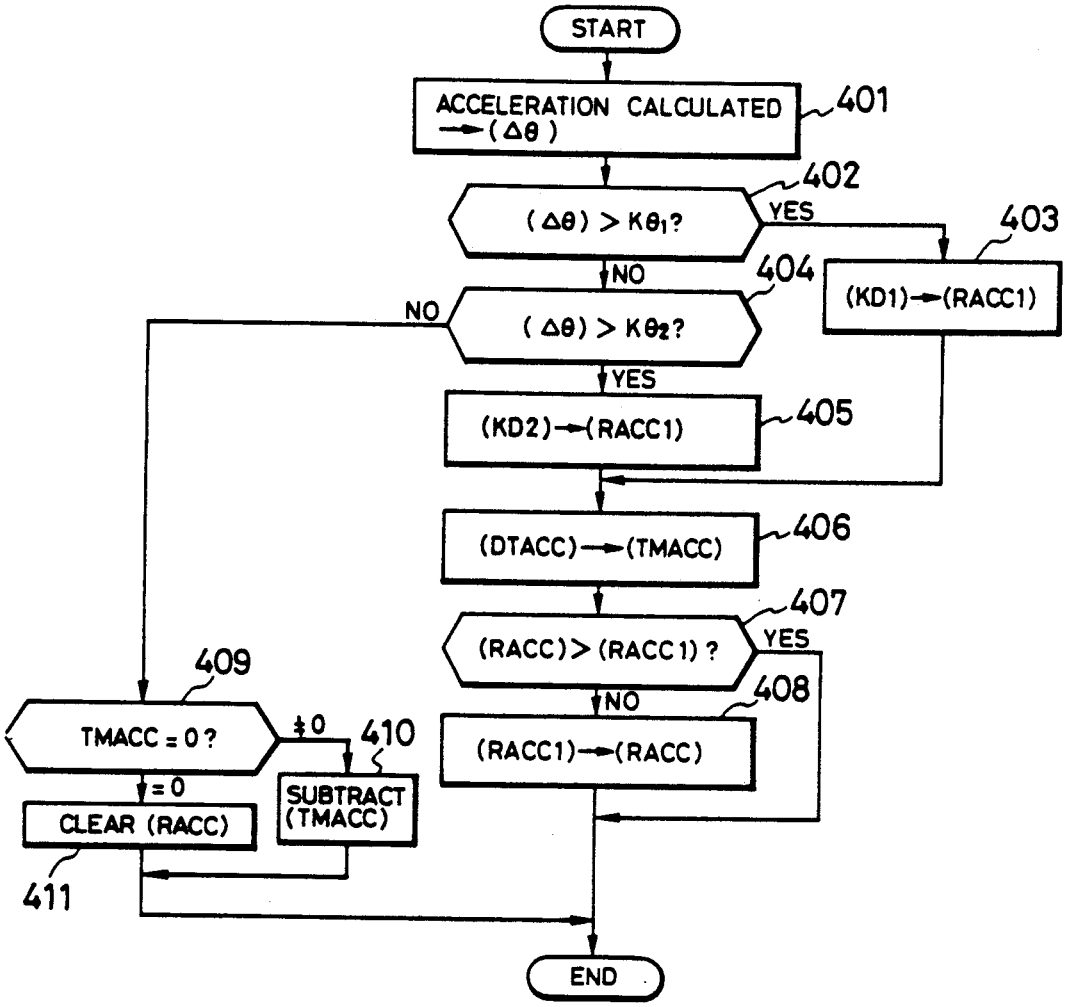
FIG. 16 is a flowchart illustrating the details of part of the flowchart for the embodiment.

Referring to FIGS. 16–18, the relevant details of STEPs 1013, 1014, 1015 at the time of accelerated operation in the flowchart of FIG. 4 will be described. FIG. 16 shows the illustration details of STEP 1014 of FIG. 4.

In STEP 401 of FIG. 10, the rate of change of the valve opening is detected from the rate of change of the output signal of the valve opening detector 34 at fixed time intervals of, e.g., 80 msec and stored in an acceleration registered $\Delta\theta$.

In STEP 402, the CPU 380 determines that the first accelerated operating condition has been established when the rate of change of the valve opening exceeds a predetermined range of change $K\theta_1$ and, in STEP 403, the CPU 380 stores the acceleration increasing duty $KD_1$ given to the main fuel solenoid valve 14 in an acceleration increasing duty storage register RACC1 and predetermined acceleration increasing time DTACC in an acceleration increasing timer. The CPU 380 then proceeds to the next step.

In STEPs 407, 408, the contents of an acceleration increasing duty storage register RACC storing the present acceleration increasing duty and the contents of the acceleration increasing duty storage register RACC1 set in STEP 403 are compared and the greater is left in the acceleration increasing duty storage register RACC as an acceleration increasing duty Da%.

When the rate of change of the valve opening in judged smaller than the predetermined rage of change $K\theta_1$ in STEP 402, it is compared with a range of change $K\theta_2$ which is smaller than the range change $K\theta_1$ in STEP 404 and, when it is greater than the rate of change $K\theta_2$, the acceleration increasing duty $KD_2$ given to the main fuel solenoid valve 14 is stored in the acceleration increasing duty storage register RACC1 as the acceleration increasing duty Da% in STEP 405. The CPU 380 then proceeds to STEP 406 and the aforesaid control is implemented in STEPs 407, 408.

When the rate of change of the valve opening is smaller than the rate of change $K\theta_2$ in STEP 404, the CPU 380 proceeds to STEPs 409–411 and controls the accelerating increasing timer TMACC.

When the acceleration increasing timer TMACC is not "0" in STEP 409, a predetermined value is subtracted from the TMACC in STEP 410 and terminates the processing. When the acceleration increasing time measuring timer TMACC is judged that it has reached "0" in STEP 409, i.e., when the acceleration increasing time DTACC set in STEP 406 elapses after the CPU 380 starts following STEP 404 to STEP 409, it proceeds to STEP 411 and clears the contents of the acceleration increasing duty storage register RACC.

The reason for the necessity of the processing in STEPs 407, 408 will be described. If the acceleration increasing duty is directly written to the acceleration increasing duty storage register RACC in STEPs 403, 405 each, irregularity shown in FIG. 17 will occur.

More specifically, the acceleration increasing time DTACC set in STEP 406 is measured up to $t_1$ after the acceleration increasing condition is temporarily given at $t_0$ in FIG. 17 with the acceleration increasing duty $KD_1$ set up in STEP 403. As the acceleration increasing duty $KD_1$ has been stored in the acceleration increasing duty storage register RACC during that time, the acceleration increasing duty is stored because an acceleration increasing condition is newly established in STEP 404 at $t_1$. The contents of the register RACC are replaced with an acceleration increasing duty $KD_2$, which is then reflected on the main fuel solenoid valve 14 as the acceleration increasing duty during the accelerating increasing time DTACC.

Since the acceleration increasing duty $KD_2$ given between $t_2$ and $t_3$ is smaller, though the acceleration increasing duty $KD_2$ should be given up to $t_3$ after the acceleration increasing duty $KD_1$ is given up to $t_2$, irregularities thus brought about results in reduction in the operating performance.

When the accelerating condition is resulted from the addition of the processing shown in STEPs 407, 408 at the timing referred to in FIG. 17, the acceleration increasing duty shown in FIG. 18 will be given and consequently any reduction in operating performance can be prevented.

Although the acceleration increasing duty imposed between $t_2$ and $t_3$ becomes greater, it poses no serious problem.

As set forth above, since the acceleration increasing duty Da% corresponding to the accelerating operation is given to the main fuel solenoid valve 14 during the accelerating operation, it becomes possible to correct the acceleration pump by setting the basic fuel injection of the acceleration pump 39 at a rather small value and supplying the required fuel quantity in conformity with the accelerated operating condition from the main fuel solenoid valve 14.

Although the description above refers to an example wherein the controlled variable is changed in proportion to acceleration, the fuel injection from the acceleration pump can be optimized in a wide temperature range by setting the controlled variable greater at the time of low temperatures and smaller at high temperatures even if a value exceeding the predetermined acceleration is detected likewise.

Although the description above refers to an example wherein the main fuel solenoid valve 14 is not used in the steady-state mode under the feedback control, the present invention is needless to say applicable to the solenoid valve even when only one solenoid valve is used under the feedback control for air-fuel ratio control.

Although the description above refers to an example wherein the increasing duty is separately computed at the time of acceleration to correct the basic controlled duty value, the idea described in reference to FIG. 18, may be adopted even if the accelerating operation is set as one of the open loop conditions.

As set forth above, the acceleration increasing duty corresponding to acceleration is given to the fuel control solenoid valve during a predetermined interval at the time of accelerating operation. Accordingly, the present invention has the effect of obtaining an inexpensive system capable of satisfying the operating performance requirements while minimizing supply fuel.

We claim:

1. An air-fuel ratio control system for use in an internal combustion engine, said system comprising fuel supply means equipped with a carburetor incorporating an acceleration pump for supplying fuel to said internal combustion engine and at least one duty-controlled solenoid valve for supplying fuel to said internal combustion engine and being adapted to control the air-fuel ratio; operating condition detecting means for detecting an operating condition of said internal combustion engine; acceleration control variable decision means for detecting an acceleration condition of said internal combustion engine, and for setting a predetermined acceleration controlled-variable for said solenoid valve during different acceleration control times determined in accordance with the detected operating condition and the detected acceleration condition; and controlled variable decision means for determining the controlled duty of said solenoid valve according to data from said operating condition detecting means and when a controlled variable is given by said acceleration control variable decision means at the time of acceleration, according to the acceleration controlled-variable.

2. An air-fuel ratio control system for use in an internal combustion engine as claimed in claim 1, wherein said acceleration control variable decision means comprises acceleration decision means for detecting the accelerated operating condition; acceleration control time decision means for determining an optimum acceleration control time corresponding to each operating condition according to the outputs of said operating condition detecting means and said acceleration decision means; acceleration control time measuring means for measuring the acceleration control time given by said acceleration control time decision means; comparison means for comparing acceleration control time newly set by said acceleration control time decision means with the value of the residual time for acceleration control derived from said acceleration control time measuring means and for setting longer time data to said acceleration control time measuring means; and means for supplying the acceleration controlled-variable to said controlled variable decision means while said acceleration control time measuring means is measuring acceleration control time when said acceleration decision means makes its decision.

3. The air-fuel ratio control system as claimed in claim 1, wherein said operating condition detecting means comprises a valve opening detector for outputting a voltage signal in accordance with the opening of a throttle valve, and an engine speed detector for detecting engine speed.

4. An air-fuel ratio control system for use in an internal combustion engine, said system comprising fuel supply means equipped with a carburetor incorporating an acceleration pump for supplying fuel to said internal combustion engine and at least one duty-controlled solenoid value for supplying fuel to said internal combustion engine and being adapted to control the air-fuel ratio; operating condition detecting means for detecting an operating condition of said internal combustion engine; acceleration controlled-variable decision means for detecting an acceleration condition of said internal combustion engine, and for outputting a predetermined acceleration controlled-variable determined in accordance with the detected operating condition and the detected acceleration condition during a predetermined interval; and controlled variable decision means for determining the controlled duty of said solenoid valve according to data from said operating condition detecting means and when the controlled-variable is given by said acceleration controlled-variable decision means at the time of acceleration, according to the acceleration controlled variable so as to correct the fuel quantity being injected by said acceleration pump.

5. An air-fuel ratio control system for use in an internal combustion engine as claimed in claim 1, wherein said acceleration control variable decision means comprises acceleration decision means for detecting accelerated operating condition; acceleration control time measuring means for measuring time during which a fuel quantity is supplied for a predetermined interval at the time of acceleration after the accelerated operating condition is detected by said acceleration decision means; means for computing a different acceleration controlled-variable corresponding to the acceleration detected by said acceleration decision means; acceleration controlled-variable storage means for storing the acceleration controlled-variable while acceleration is being controlled, the contents thus stored being cleared after the termination of acceleration control time; and selective means for comparing outputs of said computing means and said acceleration controlled-variable storage means and for supplying, based on the comparison, the greater output to said acceleration controlled-variable storage means, thereby storing a fuel supply which is greater in quantity.

6. The air-fuel ratio control system as claimed in claim 3, wherein said operating condition detecting means comprises a valve opening detector for outputting a voltage signal in accordance with the opening of a throttle valve, and an engine speed detector for detecting engine speed.

* * * * *